US006717493B2

(12) United States Patent
Chopra et al.

(10) Patent No.: US 6,717,493 B2
(45) Date of Patent: Apr. 6, 2004

(54) RF CABLE HAVING CLAD CONDUCTORS AND METHOD OF MAKING SAME

(75) Inventors: Vijay K. Chopra, Palos Park, IL (US); Hugh Robert Nudd, Mokena, IL (US)

(73) Assignee: Andrew Corporation, Orland Park, IL (US)

( * ) Notice: Subject to any disclaimer, the term of this patent is extended or adjusted under 35 U.S.C. 154(b) by 45 days.

(21) Appl. No.: 10/100,541

(22) Filed: Mar. 18, 2002

(65) Prior Publication Data

US 2003/0174030 A1 Sep. 18, 2003

(51) Int. Cl.[7] ..... H01P 3/06; H01B 5/14
(52) U.S. Cl. ..... 333/237; 333/243
(58) Field of Search ..... 333/236, 237, 333/244, 243; 174/102 R

(56) References Cited

U.S. PATENT DOCUMENTS

| | | | | |
|---|---|---|---|---|
| 3,360,409 A | | 12/1967 | Jachimowicz et al. | 228/130 |
| 3,717,719 A | | 2/1973 | Smith et al. | 174/107 |
| 3,754,094 A | | 8/1973 | Ziemek et al. | 174/102 A |
| 3,789,129 A | | 1/1974 | Ditscheid | 174/28 |
| 3,812,283 A | | 5/1974 | Kothe et al. | 174/105 R |
| 4,346,253 A | | 8/1982 | Saito et al. | 174/29 |
| 4,628,150 A | * | 12/1986 | Luc | 174/88 C |
| 5,656,796 A | * | 8/1997 | Marinos et al. | 174/74 R |
| 5,926,949 A | | 7/1999 | Moe et al. | 29/828 |
| 5,946,798 A | | 9/1999 | Buluschek | 29/828 |
| 5,959,245 A | | 9/1999 | Moe et al. | 174/36 |
| 6,130,385 A | | 10/2000 | Tuunanen et al. | 174/110 PM |
| 6,137,058 A | | 10/2000 | Moe et al. | 174/102 R |
| 6,342,677 B1 | | 1/2002 | Lee | 174/106 R |

FOREIGN PATENT DOCUMENTS

| | | | |
|---|---|---|---|
| WO | WO 01/99122 A1 | 12/2001 | H01B/11/18 |

* cited by examiner

*Primary Examiner*—Robert Pascal
*Assistant Examiner*—Dean Takaoka
(74) *Attorney, Agent, or Firm*—Welsh & Katz, Ltd.

(57) ABSTRACT

An RF coaxial cable with clad conductors includes an inner tubular conductor having a first base layer formed of a relatively higher conductivity material, and a first bulk layer formed of a relatively lower conductivity material. The first base layer of higher conductivity material extends over an area greater than an area of the first bulk layer to form first margin regions composed of only the higher conductivity material. The first margin regions of the first base layer of the higher conductivity material are joined together to form the inner tubular conductor with only the first margin regions of the higher conductivity material being joined. Also included is a dielectric material surrounding the inner conductor, an outer tubular conductor formed in the same manner as the inner conductor. The first base layer of higher conductivity material of the inner tubular conductor faces outwardly toward the dielectric material and the higher conductivity material corresponding to the outer tubular conductor faces inwardly toward the dielectric material.

19 Claims, 5 Drawing Sheets

RF CABLE HAVING CLAD CONDUCTORS AND METHOD OF MAKING SAME

FIELD OF THE INVENTION

The present invention relates generally to radio-frequency conductors and more specifically to an RF multi-layer clad coaxial cable.

BACKGROUND

Coaxial cables and other radio frequency (RF) cables are known in the art for transmitting high frequency signals. Known conventional coaxial cables are typically formed from an inner tube of conducting metal, a dielectric material surrounding the inner tube, and an outer tube of conducting metal. The conductors may be tubular or solid. The two tubes formed of metal or other electrically conductive material are disposed concentrically with the dielectric material disposed between the two tubes. The conductivity of the material used to form the tubes, and the relative permittivity and dissipation factor of the dielectric material determines the RF attenuation of the resulting coaxial cable.

As is known in the art, at radio frequencies the current flowing through the conductive tubes of the cable tends to flow only in and directly beneath the surfaces of the conducting tubes. This is commonly known as the "skin effect." More particularly, current flows through and directly beneath an inside surface of the outer tube and an outside surface of the inner tube.

Each tube may be typically manufactured by bending a flat strip of conductive material or other thin metal into a round tube and welding the longitudinal edges of the material together to form a seam. To minimize manufacturing costs, the material selected for forming the tubes is preferably one that is easy to form and weld. However, the materials that provide the best cost benefit do not necessarily offer the preferred RF electrical conductivity.

Additionally, materials such as copper provide excellent electrical characteristics, but are relatively expensive. To reduce manufacturing costs, it is known to form the conductive tubes of cladding material or layers of different metal to minimize the use of relatively costly material. For example, it is known to form the conductive tubing from copper and aluminum layers. However, the copper-aluminum boundary presents difficulty when welded.

U.S. Pat. No. 6,342,677 B1 assigned to Trilogy Communications, Inc. discloses a high frequency cable made of clad material. In this cable, a base layer of low conductivity material extends past the longitudinal edges of a layer of high conductivity material. When the strip is formed into a tube, "clearance" edges formed of the low conductivity material are welded. However, such low conductivity material may be more difficult to weld than the high conductivity material. The presence of low conductivity materials in the RF path to degradation of the electrical properties, which is undesirable.

Accordingly, there is a need for a coaxial cable that has high conductivity to minimize RF attenuation, is relatively economical to manufacture by minimizing use of expensive metals, yet is easy to manufacture and weld.

BRIEF DESCRIPTION OF THE DRAWINGS

The features of the present invention which are believed to be novel are set forth with particularity in the appended claims. The invention, together with further objects and advantages thereof, may best be understood by reference to the following description in conjunction with the accompanying drawings.

DETAILED DESCRIPTION

In this written description, the use of the disjunctive is intended to include the conjunctive. The use of definite or indefinite articles in not intended to indicate cardinality. In particular, a reference to "the" object or thing or "an" object or "a" thing is intended to also describe a plurality of such objects or things.

Figure 1A:
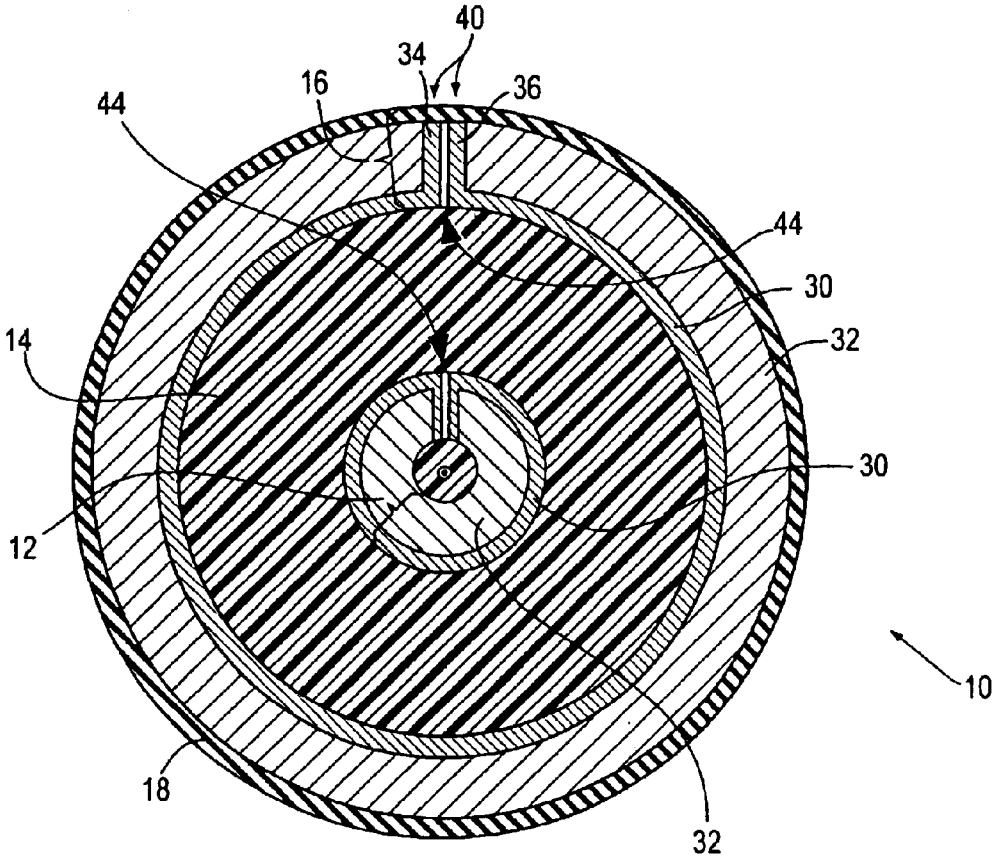
FIG. 1A is a is a cross-sectional view of a specific embodiment of a coaxial RF cable showing inner and outer conductors, according to the present invention.
Figure 1B:
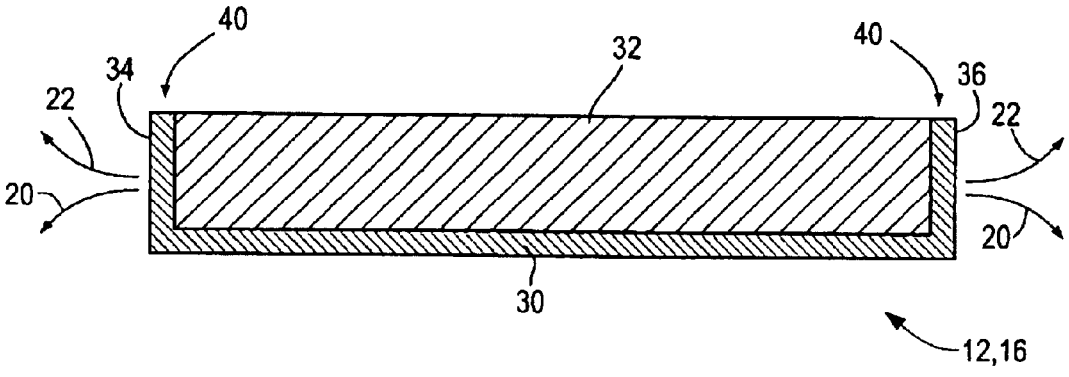
FIG. 1B is a end view of either the inner conductor or the outer conductor of FIG. 1A shown flat before it is formed into a tube.
Figure 1C:
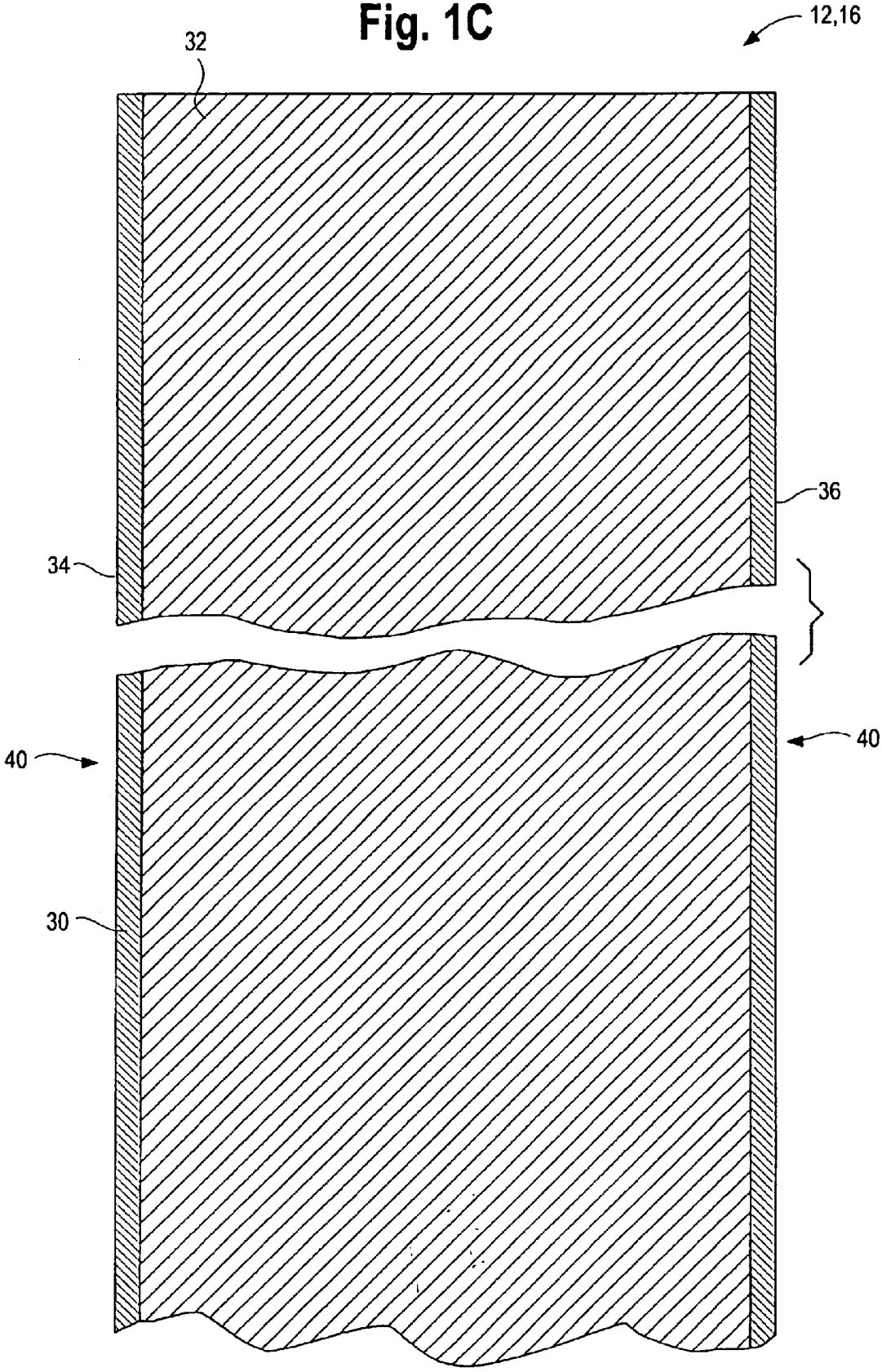
FIG. 1C is a top plan view of the conductor of FIG. 1B.

Referring now to FIGS. 1A–1C, a preferred embodiment of a coaxial cable 10 is shown generally. The coaxial cable 10 may include an inner tubular conductor 12, a layer of foam dielectric material 14 surrounding the inner conductor, an outer tubular conductor 16 which surrounds the layer of dielectric material, and a jacket of weatherproofing material 18 surrounding the outer conductor. The dielectric may be solid, liquid, foam or air, as is known in the art.

FIG. 1B shows the conducting material in a flat orientation before it is formed into either the inner or outer conductors 12, 16. Similarly, FIG. 1C shows either the inner or outer strip of conductors 12, 16 from a top perspective view. Note that the configuration of both the inner and outer conductors 12, 16 may be similar except for the dimensions and a direction of curvature. For purposes of clarity only, the following discussion will generally refer to the outer conductor 16 because such discussion may equally apply to the inner conductor 12. Preferably, the same metal combination is used to construct both the inner and outer conductors 12, 16 of one coaxial cable 10, but not necessarily so, depending upon the application.

Figure 2A:
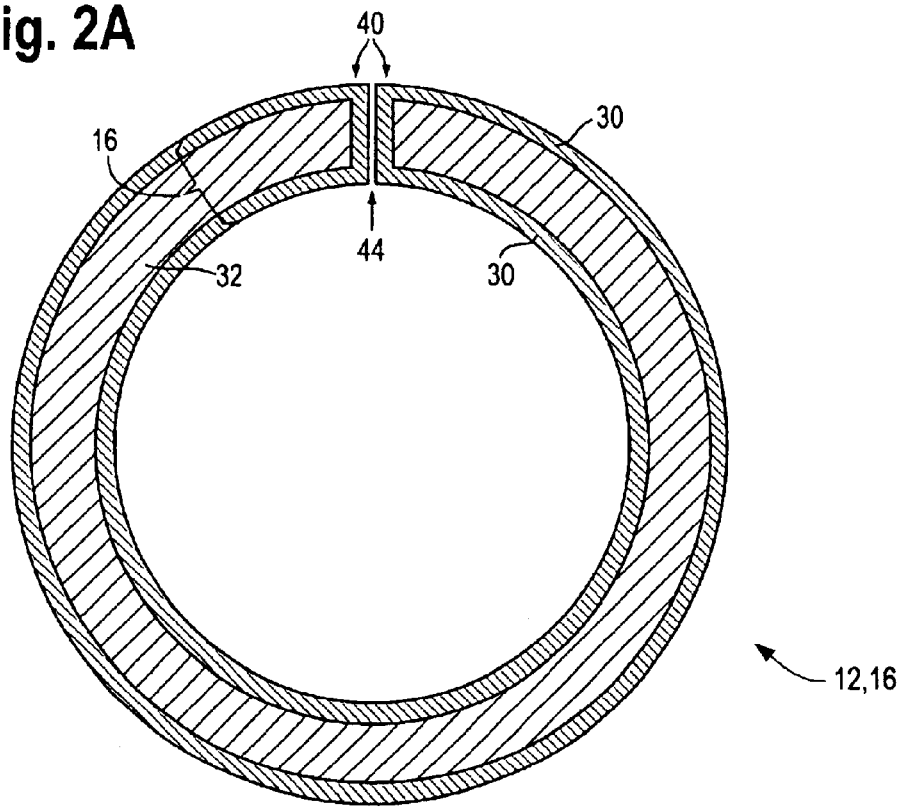
FIG. 2A is a cross-sectional view of a specific alternate embodiment for a coaxial RF cable showing either the inner conductor or the outer conductor, according to the present invention.
Figure 3A:
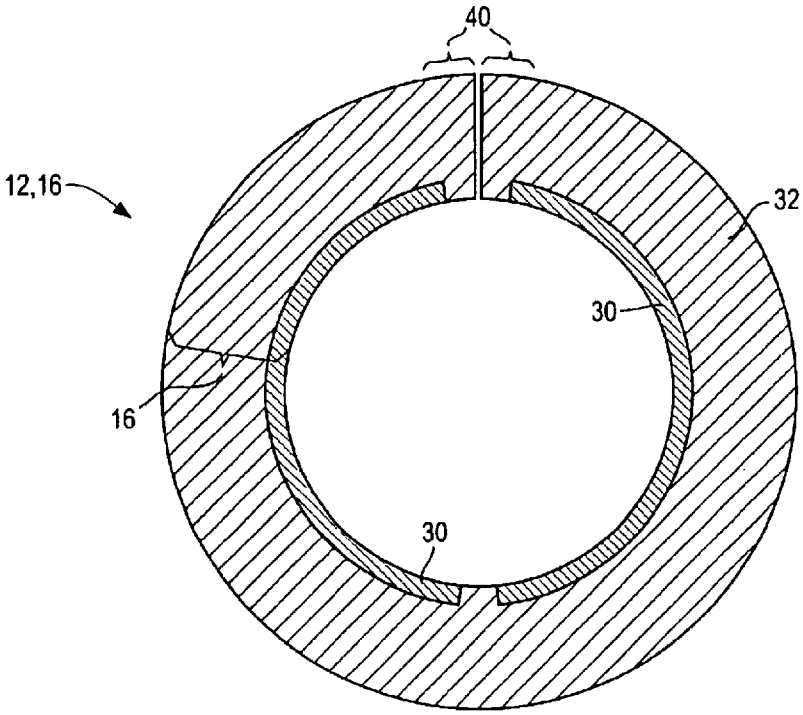
FIG. 3A is a cross-sectional view of a specific alternate embodiment of a coaxial RF cable showing either the inner conductor or the outer conductor where the conductor includes two strips of conductive material, according to the present invention.

With respect to forming the tube for example, the outer conductor 16 may be formed by bending edges of the conductors of FIG. 1B in a direction shown by arrows 20, while the inner conductor 12 may be formed by bending the edges of the material in the opposite direction, as shown by arrows 22. Note that FIG. 1A shows both the inner conductor 12 and the outer conductor 16, while FIGS. 2A and 3A show only the outer conductor. This is done for reasons of clarity only. Of course, an RF cable 10 includes both the inner and outer conductors 12, 16. As described later, a single conductor may be used as an RF wave guide according to the present invention.

The outer conductor 16 is formed from two strips of material, as shown in the end cross-sectional view of FIG. 1B. The outer conductor 16 includes a base layer 30 formed of a relatively higher conductivity material, and a bulk layer 32 formed of a relatively lower conductivity material. For example, preferably the higher conductivity material may be copper, while the lower conductivity material may be aluminum. Various suitable combinations of materials may be used, such as copper and aluminum, copper and aluminum-bronze, copper and steel, copper and stainless steel, aluminum and brass, and the like. Generally, metals that may be used are copper, aluminum, aluminum-bronze, steel, stainless steel, and bronze. However, any suitable metal may be used, such as very expensive metals like gold and silver. Accordingly, the combinations and permeations of the metals that may be used are extensive, and are not limited by the specific embodiments described herein.

Note that the phrases "relatively higher" and "relatively lower" merely refer to the relative conductivity between the two materials. It is not meant to indicate that one of the materials is truly considered to be a highly conducting material in accordance with industry standards. It is sufficient that one material is a better conductor than the other. For example, copper and aluminum may be used where copper is the higher conductivity material and aluminum is the lower conductivity material. However, in another cable, aluminum may be used as the higher conductivity material and stainless steel (or steel, bronze, brass) may be used as the lower conductivity material. Similarly, gold or silver may be used as the higher conductivity material and copper may be used as the lower conductivity material.

The metallic materials are selected according to their electrical and mechanical characteristics. For example, the material of which the base layer 30 of the high conductivity material is formed may be selected for its superior conductivity characteristics. As described above, for example, gold, copper or silver may be used to form the high conductivity layer. With respect to the mechanical characteristics of the metallic materials, the selection of the material combination to be used for the two layers 30, 32 may be based on the differential thermal expansion between the two materials.

Still referring now to FIGS. 1A–1C, the amount of such material used to form the base layer 30 of relatively higher conductivity material is minimal or less than amount of material used to formed the bulk layer 32. This permits the cable 10 to be manufactured and sold at a competitive price because the amount of expensive metal is reduced. As shown in the drawings, but not necessarily shown to scale, the thickness of the material used to form the bulk layer 32 may be greater that the thickness of the material used to form the base layer 30. This minimizes the use of the relatively expensive higher conductivity material, and in many configurations, results in a cable having a reduced weight.

As more clearly shown in FIG. 1C, the base layer 30 of higher conductivity material has first and second oppositely disposed longitudinal edges 34, 36. The longitudinal edges 34, 36 extend over an area greater than an area of the bulk layer 32 so as to form a first margin region 40 of only high conductivity material. In other words, the margin region 40 is totally free of the lower conductivity material of the bulk layer 32.

Further, the low conductivity bulk layer 32 may be disposed on the high conductivity base layer 30 by any suitable method, including but not limited to cladding, electro-deposition, sputtering, plating, electro plating, and the like. Alternatively, the higher conductivity base layer 30 may be disposed on the lower conductivity bulk layer 32 instead of the reverse, without departing from the scope of the invention.

In the embodiment shown in FIGS. 1A–1C, it is noteworthy that the margin regions 40 contain only the higher conductivity material and do not contain any of the lower conductivity material of the bulk layer 32. This permits the first and second longitudinal edges 34, 36 of the base layer 30 of higher conductivity material to be joined together to form either the inner tubular conductor 12 or the outer tubular conductor 16. In that regard, only the material forming the margin regions 40 having only the higher conductivity material is joined. Preferably, a joint 44 (FIG. 1A) is formed using a welding technique, as is known in the art. Because the joint region 44 is formed of a single material, namely, the higher conductivity material, welding is straight forward. Accordingly, the welded joint area 44 is formed, as shown in FIG. 1A. In known cables where dissimilar metals are used at a joint or boundary, or where multiple layers of different material are welded, welding may be difficult and problematic because the two metals tend to mix and form metallic byproducts that interfere with the integrity of the joint. Such joints are often brittle or contribute to electrical attenuation.

To form either the inner conductor 12 or the outer conductor 16, the sheet of flat material or cladding shown in FIGS. 1B and 1C is folded or curved such that the first and second longitudinal edges 34, 36 are brought together. Once the first and second longitudinal edges 34, 36 are in proximity with each other, the margin region 40, which is defined by the thickness of the layers, may be welded by conventional techniques. Because the margin regions 40 contains material formed only of the higher conductivity layer, the welding process may be selected based on the characteristics of only that material alone. Accordingly, for example, where copper and aluminum are used, the manufacturer need only consider the characteristics of the copper layer, i.e., the base layer 30 of relatively higher conductivity material, rather than the aluminum layer. This obviates the problem of dealing with the formation of brittle intermetallics or other problems normally associated with welding a copper-aluminum combination.

As previously described, both the inner tubular conductor 12 and the outer tubular conductor 16 may be formed from the same configuration of material, where the direction of bending or tube formation determines whether the layer of high conductivity material is on the outside of the tube or the inside of the tube. For improved transmission and electrical characteristics of the coaxial cable 10, in view of the skin effect phenomena described early, the inner conductor 12 is formed such that the base layer 30 formed of the higher conductivity material faces outwardly toward the foam dielectric material 14, while the outer conductor 16 is formed such that its base layer 30 of higher conductivity material faces inwardly toward the foam dielectric material. Accordingly, due to the skin effect, the majority of electrical current flows through the layers of higher conductivity material, which is essentially the "skin" layer of each conductor.

Figure 2B:
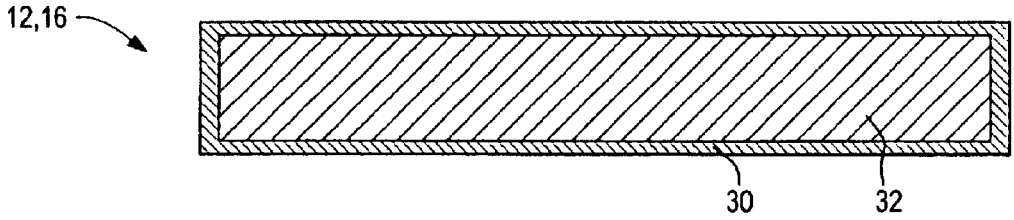
FIG. 2B is a end view of the conductor of FIG. 2B shown flat.

Referring to FIGS. 2A–2B, a specific alternative embodiment of a coaxial cable 10 is shown. Like reference numbers are used to show like structures. In FIG. 2A, again only the outer conductor 16 is shown for reasons of clarity. Of course, a complete cable would include both the inner conductor 12 and the outer conductor 16 in addition to the dielectric material 14 disposed therebetween. In this embodiment, again, each of the conductors 12, 16 is made from a flat arrangement of two materials, namely, the base layer 30 formed of the higher conductivity material and the bulk layer 32 formed of the lower conductivity material.

Clearly, in this configuration, it is immaterial whether the flat layers of material shown in FIG. 2B are bent in a convex manner or a concave manner to form the tubular conductor 12, 16, because the conductor is symmetrical. As shown in FIG. 2B, the base layer 30 of higher conductivity material completely surrounds the bulk layer 32 of lower conductivity material.

Figure 2C:
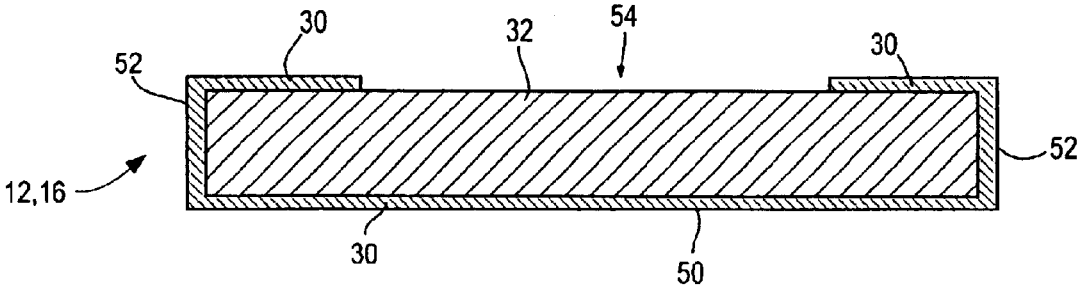
FIG. 2C is a end view of a specific alternate embodiment of a conductor showing either the inner conductor or the outer conductor.

Turning now to the specific alternate embodiment of FIG. 2C, the base layer 30 substantially surrounds the bulk layer 32. To "substantially" surround the bulk layer 32, the base layer 30 need only fully enclose three sides, namely, a bottom side 50 and two edge portions 52, while a top side 54 need only be partially covered. As shown in FIG. 2C, the top side 54 is about 42% covered by the base layer 30 material, but any percent coverage may be used. Of course, when 0% coverage is used, the configuration appears like that shown in FIG. 1B. Similarly, when 100% coverage is used, the configuration appears like that shown in FIG. 2B.

Accordingly, to the embodiment of FIG. 2C, the flat layers are bent to form the inner tubular conductor 12 and the outer tubular conductor 16 such that the unbroken layer or top side 50 layer forms the surface that abuts the foam dielectric material.

Figure 3B:
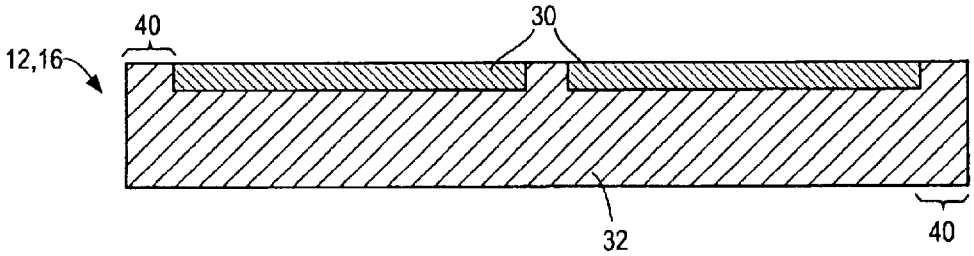
FIG. 3B is a end view of the conductor of FIG. 3A.

Turning now to FIGS. 3A–3B, a specific alternative embodiment of either the inner conductor 12 or the outer conductor 16 is shown. Again, for purposes of clarity only, FIG. 3A depicts the layers of cladded material forming the outer conductor 16 such that the base layer 30 of higher conductivity material is again shown facing inwardly toward the dielectric material (not shown). In this embodiment, two continuous strips 30 of the higher conductivity material is disposed along the longitudinal axis of the bulk layer 32 of lower conductivity material. Again, as described previously, copper may be used as the base layer 30, while aluminum may be used for the bulk layer 32. Note that in this specific embodiment, the lower conductivity bulk layer 32 may be aluminum, and thus when the tube is formed, an aluminum to aluminum weld is formed, rather than the copper to copper weld described in the previous embodiments.

Figure 3C:
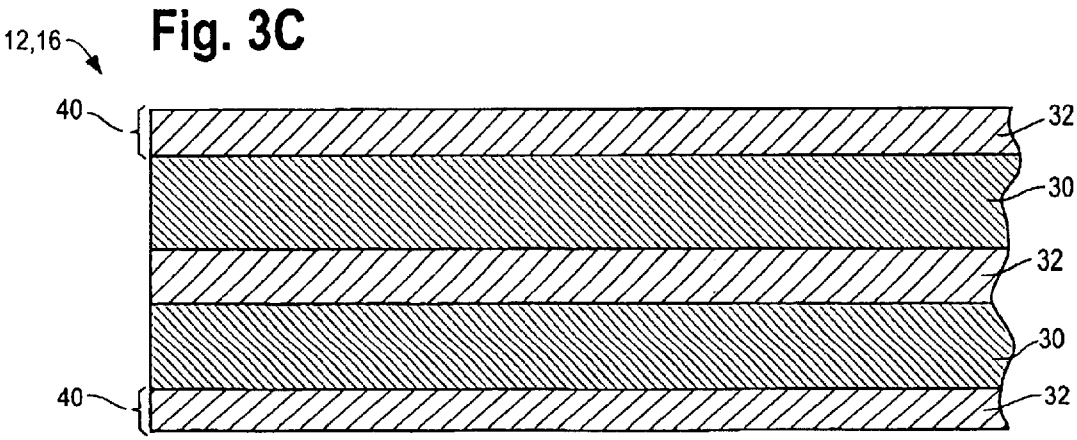
FIG. 3C is a top plan view of the conductor of FIG. 3A.

As shown more clearly in FIG. 3C, the two continuous strips 30 of the higher conductivity material are shown. However, more than two strips may be used as appropriate. In this specific embodiment, the margin regions 40 are defined by the bulk layer 32 of lower conductivity material along longitudinal edges, where no higher conductivity material is present. Accordingly, when the layered or cladded material is formed into a tube and the margin regions 40 are welded, only the material of lower conductivity in the bulk layer 32 is subjected to the weld. Again, because only a single metal is welded, the problems described above with respect to welding a combination of material is avoided.

Figure 4A:
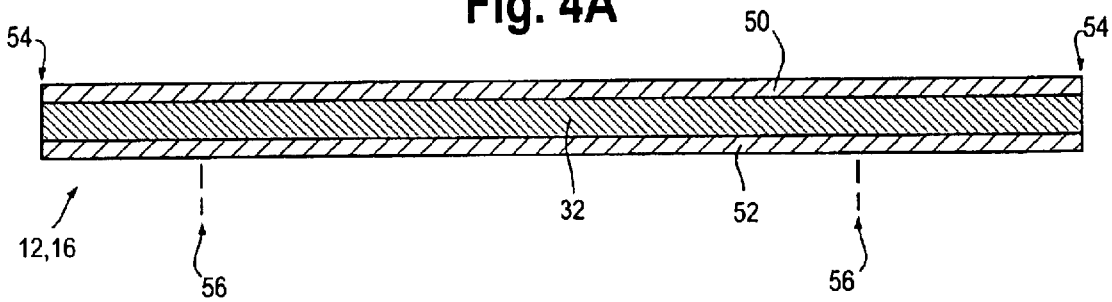
FIG. 4A is an end view of a specific alternate embodiment of either an inner conductor or and outer conductor.
Figure 4B:
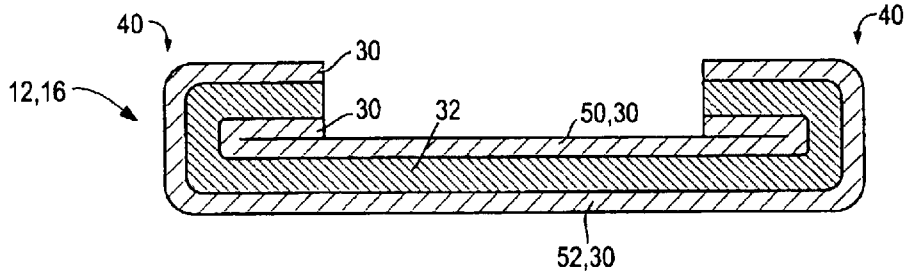
FIG. 4B is an end view of the conductor of FIG. 4A showing folded edges.

Turning now to FIG. 4, an alternate embodiment of either the inner conductor 12 or the outer conductor 16 is shown. In this embodiment, the bulk layer 32 of lower conducting material is sandwiched between an upper base layer 50 of the higher conductivity material and a lower base layer 52 of identical higher conductivity material. Of course, in this configuration, the longitudinal edges 54 are not brought together and welded because both the high conductivity material and low conductivity material would be present in the welded joint. Rather, the edges are folded over, as shown in FIG. 4B.

Accordingly, each of the longitudinal edges is folded at a location inward from the longitudinal edge, as shown in FIG. 4B by arrow 56. Because the layers of conducting material are folded along the outside longitudinal edge, the layer of higher conductivity material of the base layer 30 essentially covers the folded edge portion, which forms margin regions 40. Thus, the margin regions 40 may be brought together and welded to form either the inner tubular conductor 12 or the outer tubular conductor 16, as described above with respect to the other embodiments. Again, only the layer of the higher conductivity material is present in the welded joint.

Note that the base layer 30 and the bulk layer 32 may be formed by known methods as described above. For example, the two layers may be rolled under pressure so as to bond and form a structurally sound cladded conductor. With respect to FIG. 1C, for example, the base layer 30 of high conductivity material may be initially provided and the bulk layer 32 of the lower conductivity material may be disposed on top of the base layer so as to form the margin regions 40. This may be done by providing the bulk layer 32 having a narrower width. Preferably, the bulk layer 32 is thicker than the base layer 30 so that the base layer comprises a smaller proportion of the total amount of material than does the bulk layer. The two layers may then be fed through high pressure pinch rollers which deform the materials so as to achieve the configuration shown in FIG. 1B. Alternately, the bulk layer 32 may be "coated" with the base layer 30. Note that the thickness of the materials may not be drawn to scale.

Next, longitudinal edges of the base layer 30 are curled or smoothly deformed so as to form a tubular shape. When the edges meet or abut, as defined by the margin regions 40, a continuous longitudinal weld is made along the margin regions. Once formed, the inner tubular conductor 12 is then surrounded with the dielectric material 14. Preferably, foaming dielectric material is used, as is known in the art. The outer conductor 16 is then formed over the dielectric material 14 in a similar manner as that of the inner conductor 12. The outer conductor 16 is then sealed with the weather proof jacket 18, as is known in the art.

Figure 2D:
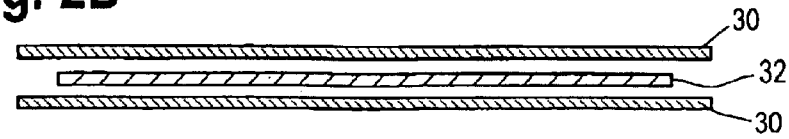
FIG. 2D is an end view of the conducting layers according to a specific method of FIG. 2B.

Turning back to the specific embodiment shown in FIG. 2B and the process for manufacturing, FIG. 2D shows that the outer conductor 16 of FIG. 2B may be formed using three separate and individual strips of material where the bottom strip or layer may be the strip of base material 30 formed of the higher conductivity material, the middle strip or layer may be the bulk layer 32 of lower conductivity material, and the top or third layer may be another strip of the base layer material. Essentially, the layer of bulk material 32 is sandwiched between two separate strips of the base material 30. The three strip assembly is then compressed via high pressure pinch rollers, as described above, to form the inner or outer conductors 12, 16. Because the metals used may be relatively malleable, the metal deformation causes a metallurgical bonding between the layers, and gives rise to the appearance of a continuous border of the base layer 30 shown in FIG. 2B.

The coaxial RF cable 10 may be manufactured in any suitable dimension, depending upon the application. The dimensions may be varied depending upon the application without departing from the scope of this invention. For example, an RF cable having a ⅞ inch diameter may have a base layer of copper about one mil in thickness and a bulk layer of aluminum about nine mils in thickness. Accordingly, the each margin region may have a width of about 125 mils. Such a cable minimizes the use of the costly base layer material. Because aluminum it about one-third of the weight of copper, clad cables made from copper and aluminum are lighter than cables made solely of copper.

Additionally, the RF coaxial cable 10 may be corrugated by known techniques to increase mechanical flexibility. Either or both of the inner conductor 12 or the outer conductor 16 may be corrugated. The above description applies equally to corrugated cables as it does to smooth wall cables.

Note that a single conductor formed with the base layer of the relatively higher conductivity material on its inside surface, similar to the construction of the outer conductor, may be used as a wave guide to transmit RF energy.

Although the tubular conductors are shown in the drawings as having a circular cross-sectional shape, any suitable shape may be used. For example, the inner and/or outer conductors may have a circular, oval, elliptical, square, or rectangular cross-section, depending upon the application. Typically, RF cables are circular, while wave guides may be circular, oval, elliptical, square or rectangular. But not necessarily so.

Specific embodiments of an RF cable having clad conductors according to the present invention have been described for the purpose of illustrating the manner in which the invention may be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

What is claimed is:

1. A radio frequency cable comprising:

an inner tubular conductor having a first bulk layer formed of a relatively lower conductivity material;

a plurality of continuous strips of a relatively higher conductivity material disposed on less than an entire surface of the first bulk layer to form first margin regions free of the higher conductivity material;

the first margin regions of the first bulk layer of lower conductivity material being joined together to form the inner tubular conductor with only the first margin regions of lower conductivity material joined;

a layer of dielectric material surrounding the inner conductor;

an outer tubular conductor having a second bulk layer formed of a relatively lower conductivity material;

a plurality of continuous strips of a relatively higher conductivity material disposed on less than an entire surface of the second bulk layer to form second margin regions free of the higher conductivity material;

the second margin regions of the second bulk layer of lower conductivity material being joined together to form the outer tubular conductor with only the second margin regions of lower conductivity material joined; and wherein the plurality of strips of the higher conductivity material of the inner tubular conductor face outwardly toward the dielectric material and the plurality of strips of the higher conductivity material of the outer tubular conductor face inwardly toward the dielectric material.

2. The cable defined by claim 1 wherein margin regions are joined with a weld.

3. The cable defined by claim 1 wherein the higher conductivity material is selected from the group consisting of copper, silver and gold.

4. The cable defined by claim 1 wherein the lower conductivity material selected from the group consisting of aluminum, aluminum-bronze, steel, stainless steel, and brass.

5. The cable defined by of claim 1 wherein the tubular conductors have a cross-sectional shape selected from group consisting of circular, elliptical, oval, square, and rectangular.

6. The cable defined by claim 1 wherein the at least one of the tubular conductors is corrugated.

7. The cable defined by claim 1 wherein the at least one of the tubular conductors is smooth-walled.

8. An RF waveguide or coaxial transmission line conductor, comprising:

a hollow tubular conductor formed from a strip having at least a first layer composed of a relatively lower conductivity material, and at least a second layer composed of a relatively higher conductivity material;

the tubular conductor having a longitudinal joint along which longitudinal edges of the strip are joined; and wherein the first layer of lower conductivity material does not extend to the joint such that only the longitudinal edges having the relatively higher conductivity material meet and form the joint.

9. The conductor defined by claim 8 herein the conductor comprises an inner conductor of a coaxial transmission line.

10. The conductor defined by claim 8 wherein the conductor comprises an outer conductor of a coaxial transmission line.

11. A coaxial transmission line having an inner and an outer conductor, said conductors as defined by claim 8.

12. The coaxial transmission line defined by claim 11 wherein the conductors are formed such that the higher conductivity materials face each other across a dielectric insulating medium.

13. The conductor defined by claim 8 wherein the joint is a weld.

14. The conductor defined by claim 8 wherein the higher conductivity material is selected from the group consisting of copper, silver and gold.

15. The conductor defined by claim 8 wherein the lower conductivity material selected from the group consisting of aluminum, aluminum-bronze, steel, stainless steel, and brass.

16. The conductor defined by claim 8 wherein the conductor is a waveguide, and wherein the higher conductivity material is on an inside portion of the waveguide.

17. The conductor of claim 8 wherein the tubular conductor has a cross-sectional shape selected from group consisting of circular, elliptical, square, and rectangular.

18. The conductor of claim 8 wherein the tubular conductor is corrugated.

19. A method of making a radio frequency cable comprising the steps of:

a) providing a first base layer formed of a relatively higher conductivity material;

b) disposing a first bulk layer formed of a relatively lower conductivity material on the first base layer so that the first base layer of higher conductivity material extends over an area greater than an area of the first bulk layer to form first margin regions composed of only the higher conductivity material;

c) joining together the first margin regions of the first base layer of the higher conductivity to form an inner tubular conductor with only the first margin regions of the higher conductivity material joined;

d) surrounding the inner tubular conductor with a dielectric material;

e) providing a second base layer formed of a relatively higher conductivity material;

f) disposing a second bulk layer formed of a relatively lower conductivity material on the second base layer so that the second base layer of higher conductivity material extends over an area greater than an area of the second bulk layer to form second margin regions composed of only the higher conductivity material; and g) joining together the second margin regions of the second base layer of the higher conductivity to form the outer tubular conductor with only the second margin regions of the higher conductivity joined, the outer tubular conductor formed over the dielectric material.

* * * * *